US007164881B2

(12) United States Patent
Donovan

(10) Patent No.: US 7,164,881 B2
(45) Date of Patent: Jan. 16, 2007

(54) APPARATUS AND METHOD FOR ESTABLISHING A DEFAULT MEDIA SIZE FOR AN IMAGING DEVICE

(75) Inventor: Michael D. Donovan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 66 days.

(21) Appl. No.: 10/838,383

(22) Filed: May 4, 2004

(65) Prior Publication Data

US 2005/0249534 A1 Nov. 10, 2005

(51) Int. Cl.
*G03G 15/00* (2006.01)
*G03G 21/00* (2006.01)

(52) U.S. Cl. ..... 399/389; 399/390; 399/388; 399/376; 399/370

(58) Field of Classification Search ..... 399/389, 399/390, 388, 370, 376
See application file for complete search history.

(56) References Cited

U.S. PATENT DOCUMENTS 4,963,896 A * 10/1990 Murasaki et al. ..... 346/134
5,528,350 A * 6/1996 Tanaka et al. ..... 399/45
5,678,124 A * 10/1997 Tokura ..... 399/26
5,689,759 A 11/1997 Isemura et al.
5,738,457 A * 4/1998 Ishida et al. ..... 400/706
5,826,156 A 10/1998 Natsume et al.
5,884,135 A * 3/1999 Moore ..... 399/361
5,890,708 A 4/1999 Song
5,946,527 A * 8/1999 Salgado et al. ..... 399/82
5,978,612 A * 11/1999 Suzuki et al. ..... 399/16
6,016,409 A * 1/2000 Beard et al. ..... 399/33
6,116,590 A 9/2000 Yokoyama et al.
6,203,220 B1 * 3/2001 Takenoshita et al. ..... 400/61
6,339,685 B1 * 1/2002 Okamoto et al. ..... 399/16
6,390,703 B1 5/2002 Kinas et al.

* cited by examiner

*Primary Examiner*—Daniel J. Colilla
*Assistant Examiner*—Marvin P. Crenshaw
(74) *Attorney, Agent, or Firm*—John V. Pezdek

(57) ABSTRACT

An imaging device, such as a printer, scanner, copier, multifunctional printer, and the like includes a sensor to detect the size of media fed into the imaging device. The detected media size can be set as the default media size for further operations, if desired.

3 Claims, 2 Drawing Sheets

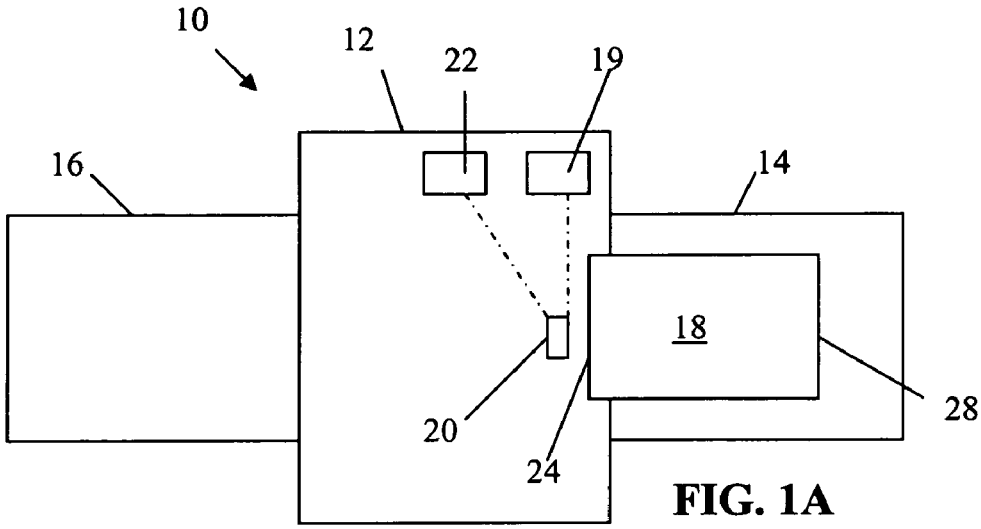
FIG. 1A
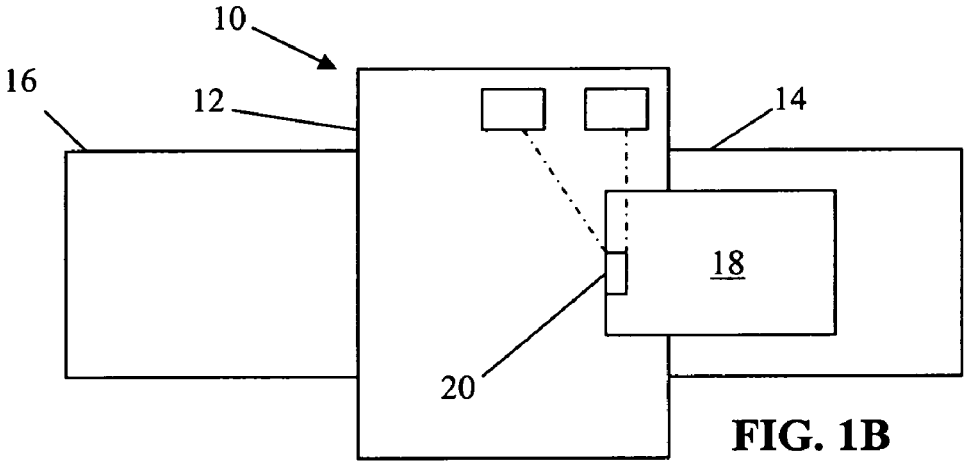
FIG. 1B
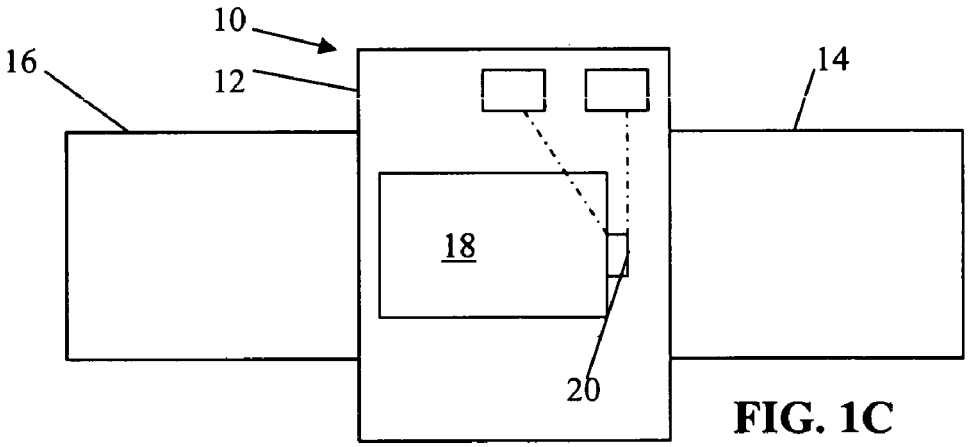
FIG. 1C
FIG. 1

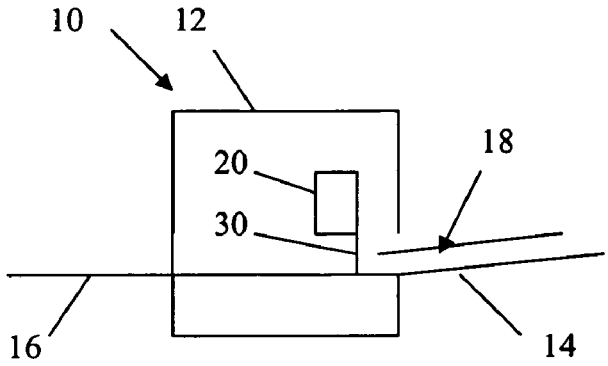
FIG. 2A
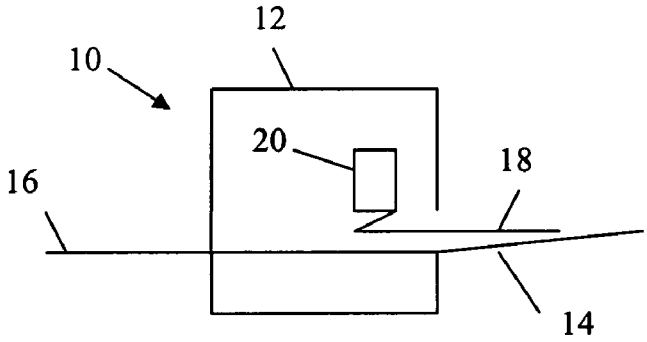
FIG. 2B
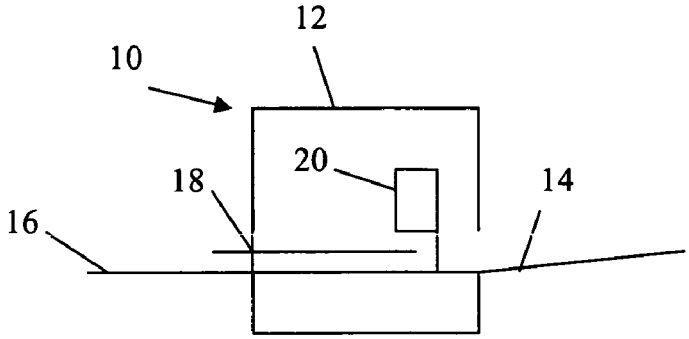
FIG. 2C
FIG. 2

APPARATUS AND METHOD FOR ESTABLISHING A DEFAULT MEDIA SIZE FOR AN IMAGING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

Many imaging devices, such as printers, copy machines, multifunctional printers, and the like, can generally produce an image on multiple media sizes. For example, several imaging devices can produce an image on letter size media, A4 size media, and legal size media, as well as some other media sizes. Most of these devices, however, have a default media setting. This setting establishes the default size of the media (i.e., letter, A4, legal, etc.) used in the absence of a selection of a media size. Often the default media must be selected via one or more buttons or pull down menus provided on the device or on a connected computer.

SUMMARY OF THE INVENTION

A system is provided for use in an imaging device, such as a printer, scanner, copier, multifunctional printer, and the like. The system includes a sensor to detect the size of media fed into the imaging device. The detected media size can be set as the default media size for further operations, if desired.

Some embodiments are directed toward a method of establishing a default media size for an imaging device. The method includes feeding at least one sheet of media into the imaging device and measuring a dimension of the media while the media is being fed through the imaging device. The measured dimension is then compared with stored data representing dimensions for select media types. One of the select media types having about the same dimension as the measured dimension is selected as the default media for future operations.

Some embodiments are directed toward a method of establishing a default media size for an imaging device. The method includes moving at least one sheet of media along a media path of an imaging device and initiating a counter as the leading edge of the media passes a media sensor. A count is then accumulated until the counter is stopped as the trailing edge of the media passes the media sensor. The accumulated count is then compared with stored data representing known counts for select media types and one of the select media types having about the same count as the accumulated count is selected as a default media for future operations.

Some embodiments are directed toward an imaging device with a default media apparatus. The imaging device includes a memory and a counter coupled to the memory. The imaging device also has a media storage area, a media feed path adjacent the media storage area, and a sensor positioned along the feed path. The sensor is adapted to initiate the counter upon sensing the leading edge of a sheet of media in the media feed path and to stop the counter upon sensing the trailing edge of the sheet of media in the media feed path. The counter accumulates a count representing the length of the media in the feed path and known counts representing the length of select media types are saved in the memory. The accumulated count is compared to the known counts to determine the type of media in the feed path and the determined media is set as a default media type for the imaging device.

Some embodiments are directed toward a method of changing the default media size of an imaging device. The method includes providing an imaging device having a current default media size and initiating an alignment of the device. At least one sheet of media is moved along a media path of the imaging device and a dimension of the media is measured while the media is moving along the media path. The measured dimension is compared with stored data representing dimensions for select media types and one of the select media types having about the same dimension as the measured dimension is selected as a future default media for future operations.

Some embodiments are directed toward a method of using an imaging device. The method includes establishing a default media. The default media is established by feeding at least one sheet of media into the imaging device and measuring a dimension of the media while the media is being fed through the imaging device. The measured dimension is then compared with stored data representing dimensions for select media types and one of the select media types having about the same dimension as the measured dimension is selected as a default media for future operations. The method of using the imaging device also includes creating an image on at least one subsequent sheet of media.

Some embodiments are directed toward an imaging device comprising a media feed path and means for detecting media size and automatically setting the detected media size as a default media type for the imaging device.

Further aspects of the present invention, together with the organization and operation thereof, will become apparent from the following detailed description of the invention when taken in conjunction with the accompanying drawings.

BRIEF DESCRIPTION OF THE DRAWINGS

FIG. 1 is a schematic top view of an imaging device embodying aspects of the present invention. FIGS. 1A–1C illustrate the movement of media through the imaging device relative to a sensor.

FIG. 2 is a schematic side view of an imaging device embodying aspects of the present invention. FIGS. 2A–2C generally correspond to FIGS. 1A–1C, respectively, and illustrate the movement of media through the imaging device relative to a sensor.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

In addition, it should be understood that embodiments of the invention can include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the inventions and other alternative mechanical configurations are possible.

Referring to FIGS. 1 and 2, an exemplary imaging device, such as a multifunction printer 10, is schematically illustrated. The illustrated multifunction printer 10 includes a system comprising at least one sensor 20 adapted to selectively detect the size of media being fed through the printer 10. As described in greater detail below, the detected size can be established as the default media size, if desired. In other non-illustrated constructions, the imaging device can support more or fewer functions than a conventional multifunctional printer. For example, the imaging device may only support printing and/or copying functions.

As illustrated, the printer 10 includes a chassis 12, an input tray 14, and an output tray 16. The input tray 14 holds media 18 prior to input and the output tray 16 holds media 18 once it has passed through the printer 10. While the input and output trays are shown on opposite sides of the printer, any other construction is possible where the input and output trays are on the top, bottom or sides in any conceivable combination.

Although it is not illustrated for the purpose of clarity, the printer also includes a media advancement mechanism and a print head or other imaging means. The media advancement mechanism directs media through the printer 10, with each sheet being pulled independently from the input tray 14 and passed downstream along a media path to the printer's imaging area or print zone. Once media enters the imaging area or print zone, the print head can selectively deposit ink on the sheet as the sheet moves past the print head.

Although it is not illustrated, the media advancement mechanism can include a motor 19 powering one or more rollers. These rollers can drive the media 18 along the feed path from the input tray 14 to the output tray 16. In some embodiments, the rollers pick consecutive sheets from the input tray 14 and pass the sheets between drive rollers and corresponding opposing rollers. The media 18 is passed through or over a print zone, such as a platen (for example) in the imaging area prior to being expelled from the printer 10. A printhead carriage (not illustrated) can be mounted above the platen for reciprocal motion during an imaging operation. The printhead carriage can house one or more ink cartridges (not illustrated) that are configured to selectively deposit ink on the media. Since many media advancement mechanisms and print heads (or other imaging means) are well known in the art, the construction of these are not illustrated and will not be described in detail. Although the above description references several components common to an ink jet imaging device, some embodiments of the present invention can be utilized in combination with a laser imaging device. Thus, toner, drums, and developing rollers can be used to form an image on media rather than the print head carriages and ink cartridges discussed above. Since laser imaging devices are well known in the art, the construction of them will not be discussed in detail.

Although the illustrated imaging device only has one input tray 14, media having different sizes can be placed in the tray. Imaging devices like the one illustrated are generally used with only one media size, and only on limited occasions are other media sizes used. As such, the imaging device can have a default media size established to perform most operations. This prevents users from having to indicate the size of the media located in the tray before or during each use. Once the default size is selected, the imaging device can treat all media, regardless of its actual size, as if it were the default size. However, in some embodiments, the imaging device may be able to sense that the media being used is not the correct size and notify the user.

Unlike conventional imaging devices that may rely exclusively upon a user manually indicating the default paper size, the present invention can use one or more sensors to detect a default paper size without the need for manual indication of size. However, some embodiments of the present invention can also support manual selection in addition to sensor detection.

Referring to FIGS. 1A–1C, the imaging device includes a sensor 20. The sensor 20 can be used to determine the size of media 18 moving along the feed path, and the sensed size can be used as the default media size, if desired. As illustrated, the sensor 20 can be positioned along the feed path to sense at least one dimension of media in the feed path.

To determine one of the dimensions of the media 18, the sensor 20 detects a first edge 24 of the media 18 and a second edge 28 of the media 18 opposite the first edge 24. The sensor 20 can then use this sensed information to determine at least one dimension of the media 18. Once at least one dimension of the media is known, the measured dimension can be compared to measurements of known media sizes to determine the size of the sensed media. Then, if desired, the media size corresponding to the size of the sensed media can be used as the default media size for future operations.

The establishment of a default media size can be initiated several ways. For example, in some embodiments, a different media size can be selected at a connected computer or on a control panel of the imaging device. However, in other embodiments, the default media size can be established automatically when an alignment is performed. Thus, when the printer 10 is first installed, an alignment can be performed and the size of the media in the input tray can be sensed and established as the default media size. Furthermore, the default media size can be sensed and established when an alignment is performed after the print head or ink cartridges are changed.

Once an alignment is initiated, an alignment page will proceed to print. As the page passes along the media path, a first edge of the page and a second edge of the page opposite the first edge are sensed. In some embodiments, such as the embodiments illustrated in FIGS. 1 and 2, a sensor 20 is positioned in the media path to sense the leading edge 24 of the media 18 and the trailing edge 28 of the media. In other embodiments (not illustrated), a sensor is positioned on the print head carriage to sense both sides of the media. In yet other embodiments, a plurality of sensors are positioned along the feed path to sense the distance between opposite sides (e.g., other than the leading and trailing edges) of the media.

In some embodiments, the media sensor(s) 20 can comprise a mechanical sensor or contacting sensor, such as a switch or lever that is moved by media in the feed path. FIG. 2 illustrates the use of a mechanical sensor. As illustrated in FIGS. 2A and 2B (generally corresponding to the movement of media from FIGS. 1A to 1B), an arm 30 of the mechanical sensor 20 can be moved or tripped by the media as the leading edge 24 of the media 18 passes the sensor 20. The arm 30 of the sensor 20 can remain in the tripped position until the trailing edge 28 of the media 18 passes by the sensor 20. As illustrated in FIG. 2C, once the trailing edge 28 of the media 18 passes the arm 30 of the sensor 20, the arm 30 of the mechanical sensor 20 can return to its initial, un-tripped position. Information regarding the tripping of this sensor 20 can be used to determine the size of the media 18 in the feed path as will be discussed in greater detail below.

Although the illustrated embodiment shows the use of mechanical or contacting sensors, other embodiments can use non-contacting sensors, such as optical sensors, or a combination of contacting and non-contacting sensors. For example, an optical sensor can replace the illustrated mechanical sensor of FIGS. 1 and 2. By placing the optical sensor in the media path, the leading and trailing edge of the media can be detected.

Once the sensor is tripped, one or more methods or mechanisms can be used to determine one or more dimensions of a sheet of media in the media path. In some embodiments, a counter 22 can count the number of steps of a stepper motor 19 driving the media through the media path while the sensor 20 is tripped. The counted number can be used to determine the size of the media in at least two ways. In a first method, the number of steps counted can be multiplied by the size of each step to determine the measured dimension. This measured dimension can then be compared with dimensions of known media sizes to determine the size of the media. The known media size that has a dimension that most closely equals the measured dimension can be set as the default media size. In a second method, the measured number of steps can be compared to previously measured steps for known paper sizes. For example, the imaging device can be preprogrammed with counter measurements of various paper sizes. Once a count is measured for the media in the media path, the measured count can be compared with the programmed counts. The media size with a programmed count that most closely equals the measured count can be set as the default media size.

Some embodiments may not need to count steps of the stepper motor. Rather, a timer can be used to determine the media dimensions. The timer can determine the amount of time that the media in the feed path trips the sensor. This measured time can be multiplied by the velocity (or average velocity) of the paper as it moves along the media path of the imaging device. The velocity can be predetermined and programmed to the imaging device for use in media size calculations. Alternatively, the measured time can be compared to programmed times for known paper sizes to determine the size of the media.

Some embodiments may use a direct current motor to move the media along the media path. In these embodiments, several techniques can be employed to determine the default media size. As described above, the time that the sensor is tripped can be measured and converted to a length. Alternatively, the position of the media can be determined by measuring the rotation of the motor shaft or other rotating element driven by the motor. For example, an encoder can be used to measure the rotation for media drive elements and/or the position of the media. By measuring the angular position or degree of movement of the motor shaft or other rotating element while the sensor is tripped, the size of the media can be established.

In some embodiments, once the process of establishing a default media is initiated, no user interaction is necessary. Thus, in the above described methods, the imaging device would automatically compare the measured dimension to known dimensions and automatically select the most appropriate media size for the default. In other embodiments, further user interaction may be desired. For example, a display may indicate the most appropriate media size or sizes relative to the measured dimension and request the user to select a default size among two or more sizes or approve the establishment of a new default size.

In operation, the process of establishing the default media size can be initiated in some embodiments by performing an alignment. During the alignment of the illustrated embodiment, media 18 will be drawn from the input tray 14 and toward a sensor 20. Once the leading edge 24 of the media 18 trips the sensor 20, a counter 22 can begin counting the number of steps of a stepper motor 19 used to move the media 18 along the feed path. The counter 22 continues to count until the trailing edge 28 of the media 18 moves past the sensor 20. Once the trailing edge 28 passes the sensor 20, the sensor 20 returns to its un-tripped position/condition and the counter 22 stops counting. Then, the measured count can be converted to a known media size, such as letter or A4. The conversion can occur by calculating a length of the measured dimension or by comparing measured counts with programmed counts for known media sizes for example.

Some imaging devices of the present invention may be used as stand alone copy machines. In other words, the imaging device may not be connected to a computer. As such, one conventional way of setting and changing paper sizes would not be available (i.e., through the use of the computer). Additionally, some embodiments of the present invention may be simplified, and as such, these embodiments may not have a user interface to indicate media size selections. Therefore, the use of sensors to detect and establish media size selections may be the only practical option available.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

I claim:

1. A method of establishing a default media size for an imaging device, the method comprising:

feeding at least one sheet of media into the imaging device;

measuring a dimension of the media while the media is being fed through the imaging device comprising:

sensing a first edge of the media and starting a timer upon sensing the first edge;

sensing a second edge of the media opposite the first edge and stopping the timer upon sensing the second edge to determine a measured time; and determining the distance between the first edge and the second edge;

comparing the measured dimension with stored data representing dimensions for select media types by comparing the measured time with predetermined times for select media types; and selecting as a default media for future operations one of the select media types having about the same dimension as the measured dimension.

2. A method of changing a default media size of an imaging device, the method comprising:

providing an imaging device having a current default media size;

initiating an alignment;

moving at least one sheet of media along a media path of an imaging device;

measuring a dimension of the media while the media is moving along the media path comprising;

sensing a first edge of the media;

sensing a second edge of the media opposite the first edge;

determining the distance between the first edge and the second edge;

starting a timer upon sensing the first edge; and stopping the timer upon sensing the second edge to determine a measured time comparing the measured dimension with stored data representing dimensions for select media types by comparing the measured time with predetermined times for select media types; and selecting as a default media type for future operations one of the select media types having about the same dimension as the measured dimension.

3. An imaging device comprising:

a media feed path; and means for detecting media size and automatically setting the detected media size as a default media type for the imaging device comprising:

a memory;

a timer coupled to the memory; and a sensor positioned along the feed path, the sensor adapted to initiate the timer upon sensing a leading edge of a sheet of media in the media feed path and to stop the timer upon sensing a trailing edge of the sheet of media in the media feed path;

wherein the timer accumulates a time representing the length of the media in the feed path and known times representing the lengths of select media types are saved in the memory, the accumulated time is compared to the known times to determine which of the known times for the select media is about the same as the accumulated time and the determined media is set as a default media type for the imaging device.

* * * * *